US007444992B2

(12) United States Patent
Ricci

(10) Patent No.: US 7,444,992 B2
(45) Date of Patent: Nov. 4, 2008

(54) COMPENSATION DEVICE AND CYLINDER HEAD ARRANGEMENT

(75) Inventor: Roberto Ricci, Livorno (IT)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 11/756,446

(22) Filed: May 31, 2007

(65) Prior Publication Data

US 2008/0000452 A1 Jan. 3, 2008

(30) Foreign Application Priority Data

Jun. 1, 2006 (EP) ..... 06011399

(51) Int. Cl.
*F02M 61/14* (2006.01)
*F02M 61/18* (2006.01)

(52) U.S. Cl. ..... 123/470

(58) Field of Classification Search ..... 123/470, 123/467, 468, 469, 472; 239/587.1, 533.11
See application file for complete search history.

(56) References Cited

U.S. PATENT DOCUMENTS 3,038,456 A 6/1962 Dreisin ..... 123/32
4,203,402 A * 5/1980 Freyn ..... 123/470
4,402,773 A * 9/1983 Morrill ..... 285/25
6,640,784 B1 11/2003 Sims, Jr. ..... 123/470
2002/0157648 A1* 10/2002 Reiter ..... 123/470
2007/0175451 A1* 8/2007 Beardmore ..... 123/470

FOREIGN PATENT DOCUMENTS

| | | |
|---|---|---|
| EP | 1262652 | 5/2002 |
| JP | 11200991 | 1/1998 |
| JP | 11210885 | 1/1998 |
| JP | 11210886 | 1/1998 |
| JP | 2002257239 | 12/2001 |
| JP | 2004301057 | 3/2003 |
| JP | 2006037866 | 7/2004 |

* cited by examiner

*Primary Examiner*—Mahmoud Gimie
(74) *Attorney, Agent, or Firm*—Baker Botts L.L.P.

(57) ABSTRACT

A compensation device has a ring-shaped body (10). The ring-shaped body (10) has an inner side (13) facing towards a center of the ring-shaped body (10) and an outer side (11) facing away from the center of the ring-shaped body (10). At least a beveled part (15) of the inner side (13) includes an acute angle with an axis (X) of the ring-shaped body (10). At least three flexible elements protrude from the beveled part (15) and are distributed around the circumference of the ring-shaped body (10).

9 Claims, 1 Drawing Sheet

COMPENSATION DEVICE AND CYLINDER HEAD ARRANGEMENT

CROSS-REFERENCE TO RELATED APPLICATIONS

This application claims priority from European Patent Application No. 06011399, which was filed on Jun. 1, 2006, and is incorporated herein by reference in its entirety.

TECHNICAL FIELD

The invention relates to a compensation device comprising a ring-shaped body.

BACKGROUND

The ring-shaped body has an inner side facing towards the center of the ring-shaped body and an outer side facing away from the center of the ring-shaped body. Further, the invention relates to a cylinder head arrangement. The cylinder head arrangement comprises the compensation device, a cylinder head with a recess, and an injector. The recess of the cylinder head comprises an injector seat for the injector. The injector is arranged in the recess of the cylinder head.

EP 1 262 652 A1 discloses a cylinder head and an injector which is arranged at the cylinder head. The injector is clamped against the cylinder head at least at one clamping area of the injector. At the clamping area, between the injector and the cylinder head, a dumping element is arranged which is generally formed by one of the materials, for example, graphite, polyformaldehyde, polytetrafluorethylen, memory metal.

SUMMARY

There exists a need for a compensation device and a cylinder head arrangement which enables a proper flexible coupling of the injector to the cylinder head.

According to an embodiment, a compensation device may comprise a ring-shaped body, an inner side facing towards a center of the ring-shaped body and an outer side facing away from the center of the ring-shaped body, wherein at least a beveled part of the inner side includes an acute angle with an axis of the ring-shaped body, and at least three flexible elements which protrude from the beveled part and which are distributed around the circumference of the ring-shaped body.

According to another embodiment, a cylinder head arrangement may comprise a Belleville spring washer or a compensation device as defined above, a cylinder head having a recess, and an injector being arranged in the recess of the cylinder head, the recess of the cylinder head comprising an injector seat for the injector, wherein the compensation device or the Belleville spring washer, respectively, being circumferentially arranged around an axial section of the injector and between the injector and the injector seat.

BRIEF DESCRIPTION OF THE DRAWINGS

The invention is explained in the following with the help of schematic drawings.

These are as follows.

Elements with the same design or function that appear in the different illustrations are identified by the same reference characters.

DETAILED DESCRIPTION

According to a first aspect, the compensation device comprises a ring-shaped body. The ring-shaped body has an inner side facing towards the center of the ring-shaped body and an outer side facing away from the center of the ring-shaped body. At least a beveled part of the inner side includes an acute angle with an axis of the ring-shaped body. Further, the ring-shaped body has at least three flexible elements which protrude from the beveled part and which are distributed around the circumference of the ring-shaped body.

If the compensation device is arranged between an injector and an injector seat in a recess of an engine head, the injector may be tilted in such a way that an axis of the injector includes an acute angle with an axis of the recess and/or, respectively, with an axis of the ring-shaped body. Then, at least one of the flexible elements is preloaded and/or compressed by the injector while the other flexible element or, respectively, elements are relaxed while staying in good contact with the injector. So, the compensation device enables a proper flexible coupling of the injector to the cylinder head.

In a further embodiment according to the first aspect, the flexible elements protrude from the ring-shaped body rectangular to the beveled part of the inner side of the ring-shaped body. This contributes to a proper compensation of the tilting of the injector.

In a further embodiment according to the first aspect, the ring-shaped body has at least three recesses which extend from the beveled part of the inner side into the ring-shaped body and which take in at least a part of the flexible elements. This contributes to a proper fixation of the flexible elements to the ring-shaped body.

In a further embodiment according to the first aspect, each flexible element comprises a spring, which is arranged in each recess of the ring-shaped body, and a sphere which protrudes from each recess of the ring-shaped body and which is coupled to the spring. This contributes to a proper contact of the flexible element to the injector while having given flexibility of the injector in the recess of the cylinder head. The given flexibility may be achieved by choosing the spring with a respective spring constant.

In a further embodiment, according to a second aspect, a cylinder head arrangement comprises the compensation device, the cylinder head, and the injector. The cylinder head has a recess. The recess of the cylinder head comprises an injector seat for the injector. The injector is arranged in the recess of the cylinder head. The compensation device or, respectively, a Belleville spring washer is circumferentially arranged around an axial section of the injector and between the injector and the injector seat.

Figure 1:
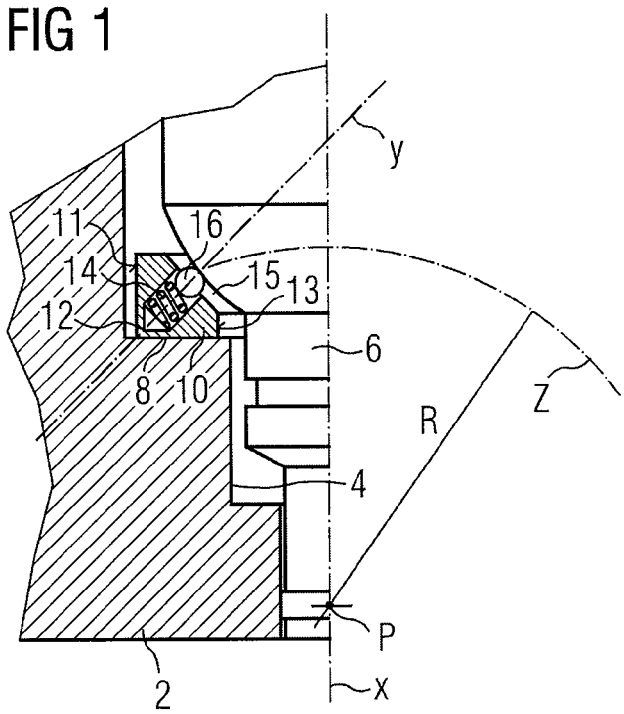
FIG. 1 a first embodiment of a cylinder head arrangement.

An internal combustion engine comprises a cylinder head arrangement (FIG. 1). The cylinder head arrangement comprises a cylinder head 2 and an injector 6. The injector 6 is arranged in a recess 4 of the cylinder head 2. The recess 4 of the cylinder head 2 comprises an injector seat 8 for the injector 6.

A compensation device preferably comprises a ring-shaped body 10. The ring-shaped body 10 is arranged between the injector 6 and the cylinder head 2, in particular, between the injector 6 and the injector seat 8 of the cylinder head 2. The ring-shaped body 10 has an inner side 13 and an outer side 11. The inner side 13 is facing towards an axis X of the injector 6 while the outer side 11 of the ring-shaped body 10 is facing away from the axis X of the injector 6. The inner side 13 comprises a part which has a surface which is parallel to the axis X and a beveled part 15 which includes an acute angle with the axis X of the injector 6.

Further, the ring-shaped body 10 comprises at least three flexible elements. Preferably, the flexible elements are arranged at the beveled part 15 of the ring-shaped body 10. The flexible elements are distributed around the circumference of the ring-shaped body 10. For example, the ring-shaped body 10 comprises three non-overlapping angular ranges, with every angular range comprising at least one of the flexible elements. Preferably, the flexible elements are distributed around the circumference of the ring-shaped body with an angular distance of about 120 degrees.

Because of system tolerances, it is not always possible to arrange the injector 6 in the recess 4 of the cylinder head 2 in such a way that the axis X of the injector 6 is parallel to an axis of the recess 4 of the cylinder head 2. In other words, the injector 6 may be tilted respectively the axis of the recess 4 of the cylinder head 2.

If the injector 6 is tilted relative to the axis of the recess 4 of the cylinder head 2, at least one of the flexible elements is compressed and/or preloaded. At least one of the other flexible elements is relaxed without losing the contact to the injector 6. So, the injector 6 is arranged very flexible in the recess 4 of the cylinder head 2 while having a proper coupling to the cylinder head 2. In other words, the injector 6 may be turned around a center P with a radius R along a circumference Z in a small angular range without losing the contact to the cylinder head 2 via the compensation device which comprises the ring-shaped body 10.

The flexible elements may be made of single pieces of rubber. Preferably, the flexible elements comprise a spring 14 and a sphere 16. Further, the ring-shaped body 10 comprises one recess 12 of the ring-shaped body 10 for each flexible element. The recesses 12 of the ring-shaped body 10 and the flexible elements are formed and arranged in such a way that the spring 14 is arranged in the recess 12 of the ring-shaped body 10 and the sphere 16 is arranged at least partly in the recess 12 of the ring-shaped body 10 while the sphere 16 is not able to fall apart from recess 12 of the ring-shaped body 10. Preferably, the recess 12 of the ring-shaped body 10 extends rectangular to a surface of the beveled part 15. The recesses 12 of the ring-shaped body 10 are distributed around the circumference of the ring-shaped body 10 with an angular distance of, preferably, 120 degrees.

Figure 2:
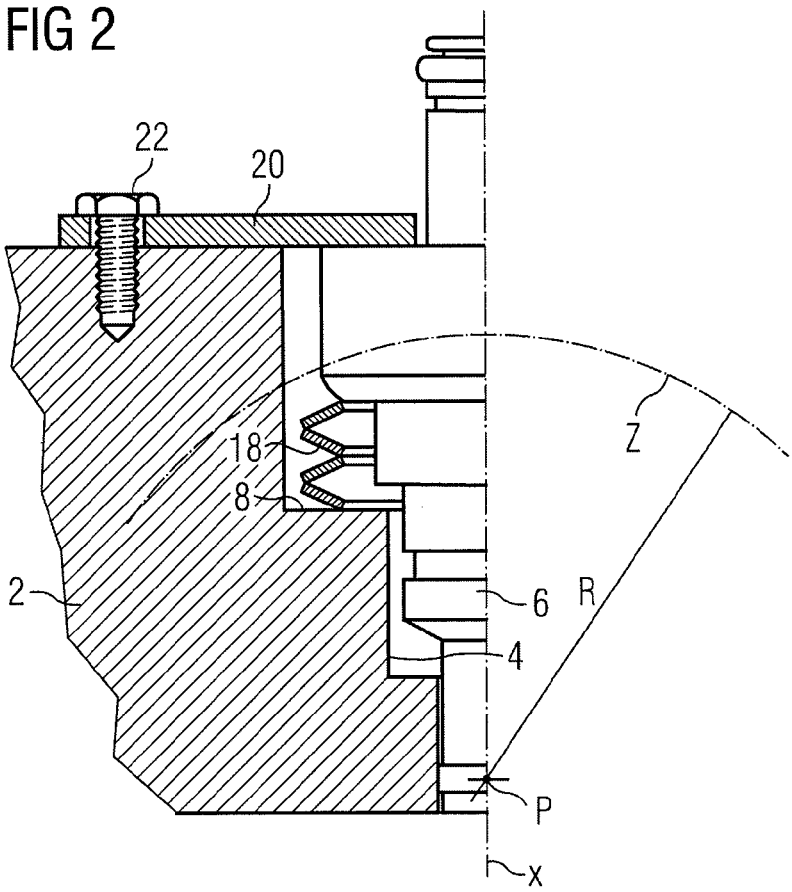
FIG. 2 a second embodiment of the cylinder head arrangement.

In an alternative embodiment, the compensation device comprises Belleville spring washers 18 (FIG. 2). The Belleville spring washers 18 are arranged between the injector 6 and the cylinder head 2, in particular, between the injector 6 and the seat 8 of the cylinder head 2. The Belleville spring washers 18 enable the tilting of the injector 6 relative to the axis of the recess 4 of the cylinder head 2 while having a proper contact of the Belleville spring washers 18 to the injector 6. In order to keep the injector 6 in its position, a clamping element 20 is fixed by a screw 22 to the cylinder head 2. The clamping element 20 protrudes from the cylinder head 2 in such a way that the injector is clamped between the Belleville spring washers 18 and the clamping element 20.

The invention is not restricted by the explained embodiments. For example, the embodiments may be combined. For example, the clamping element 20 and/or the screw 22 are arranged at the first embodiment of the cylinder head arrangement. Further, there may be an alternative device for the clamping element 20 and/or the screw 22 for keeping the injector 6 in its position. Further, the compensation device may comprise more flexible elements. Further, the flexible elements may have different angular distances to each other, for example, with four flexible elements, the preferred angular distance may be 90 degrees. Further, the flexible elements may solely comprise the spring 14. Further, there may be arranged more or less Belleville spring washers 18.

What is claimed is:

1. A compensation device comprising a ring-shaped body, an inner side facing towards a center of the ring-shaped body and an outer side facing away from the center of the ring-shaped body, wherein at least a beveled part of the inner side includes an acute angle with an axis of the ring-shaped body, and at least three flexible elements which protrude from the beveled part and which are distributed around the circumference of the ring-shaped body, wherein the ring-shaped body has at least three recesses which extend from the beveled part of the inner side into the ring-shaped body and which take in at least a part of the flexible elements.

2. The compensation device according to claim 1, wherein the flexible elements protrude from the ring-shaped body rectangular to the beveled part of the inner side of the ring-shaped body.

3. The compensation device according to claim 1, wherein each flexible element comprises a spring which is arranged in each recess of the ring-shaped body and a sphere which protrudes from each recess of the ring-shaped body and which is coupled to the spring.

4. A cylinder head arrangement comprising:

a Belleville spring washer or a compensation device comprising:

a ring-shaped body, an inner side facing towards a center of the ring-shaped body and an outer side facing away from the center of the ring-shaped body, wherein at least a beveled part of the inner side includes an acute angle with an axis of the ring-shaped body, and at least three flexible elements which protrude from the beveled part and which are distributed around the circumference of the ring-shaped body, wherein the ring-shaped body has at least three recesses which extend from the beveled part of the inner side into the ring-shaped body and which take in at least a part of the flexible elements, a cylinder head having a recess, an injector being arranged in the recess of the cylinder head, the recess of the cylinder head comprising an injector seat for the injector, wherein the compensation device or the Belleville spring washer, respectively, being circumferentially arranged around an axial section of the injector and between the injector and the injector seat.

5. The cylinder head arrangement according to claim 4, wherein the flexible elements protrude from the ring-shaped body rectangular to the beveled part of the inner side of the ring-shaped body.

6. The cylinder head arrangement according to claim 4, wherein each flexible element comprises a spring which is arranged in each recess of the ring-shaped body and a sphere which protrudes from each recess of the ring-shaped body and which is coupled to the spring.

7. A cylinder head arrangement comprising:

a compensation device comprising:

a ring-shaped body, an inner side facing towards a center of the ring-shaped body and an outer side facing away from the center of the ring-shaped body, wherein at least a beveled part of the inner side includes an acute angle with an axis of the ring-shaped body, and at least three flexible elements which protrude from the beveled part and which are distributed around the circumference of the ring-shaped body, wherein the ring-shaped body has at least three recesses which extend from the beveled part of the inner side into the ring-shaped body and which take in at least a part of the flexible elements, a cylinder head having a recess, an injector being arranged in the recess of the cylinder head, the recess of the cylinder head comprising an injector seat for the injector, wherein the compensation device is circumferentially arranged around an axial section of the injector and between the injector and the injector seat.

8. The cylinder head arrangement according to claim 7, wherein the flexible elements protrude from the ring-shaped body rectangular to the beveled part of the inner side of the ring-shaped body.

9. The cylinder head arrangement according to claim 7, wherein each flexible element comprises a spring which is arranged in each recess of the ring-shaped body and a sphere which protrudes from each recess of the ring-shaped body and which is coupled to the spring.

* * * * *